United States Patent [19]

Yamada et al.

[11] Patent Number: 4,770,722

[45] Date of Patent: Sep. 13, 1988

[54] METHODS FOR HEAT TREATMENT OF STEEL RODS

[75] Inventors: Katsuhiko Yamada; Kunio Ojima; Takashi Asakura; Yusuke Yamamori; Yukihiro Nakamura, all of Hyogo, Japan

[73] Assignee: Sumimoto Electric Inductries, Ltd., Osaka, Japan

[21] Appl. No.: 51,256

[22] Filed: May 13, 1987

Related U.S. Application Data

[63] Continuation of Ser. No. 773,158, Sep. 6, 1985, abandoned.

[30] Foreign Application Priority Data

| | | | |
|---|---|---|---|
| Sep. 7, 1984 | [JP] | Japan | 59-188636 |
| Oct. 15, 1984 | [JP] | Japan | 59-215397 |
| Oct. 17, 1984 | [JP] | Japan | 59-218948 |

[51] Int. Cl.[4] ..... C21D 11/00

[52] U.S. Cl. ..... 148/156; 72/286

[58] Field of Search ..... 148/153, 155, 156, 12 B; 72/201, 286

[56] References Cited

U.S. PATENT DOCUMENTS

| | | | |
|---|---|---|---|
| 3,390,871 | 7/1968 | McLean et al. | 266/106 |
| 3,574,000 | 4/1971 | Geipel et al. | 148/156 |
| 3,645,805 | 2/1972 | Hoffman et al. | 148/156 |
| 3,900,347 | 8/1975 | Lorenzetti | 148/12 B |
| 4,040,872 | 8/1977 | Mudiare | 148/12 B |
| 4,468,262 | 8/1984 | Kaneda et al. | 148/156 |
| 4,526,627 | 7/1985 | Iwata et al. | 148/12 B |

*Primary Examiner*—Christopher W. Brody

*Attorney, Agent, or Firm*—Sughrue, Mion, Zinn, Macpeak, and Seas

[57] ABSTRACT

A method and apparatus for the direct heat treatment of a medium- to high-carbon steel rod in which the formation of martensite is prevented, even if the starting billet contains segregation. A hot-rolled rod is transported on a conveyor in the form of a sequence of non-concentric rings. The rod is then subjected to controlled cooling in a coolant so that the greater part of any austenite in the entire length of the rod is substantially uniformly transformed to a fine pearlite structure. The sequence of non-concentric rings of the rod is next held at a temperature of 450°-630° C. for a period of 60-300 seconds, with the pitch between each ring being made smaller than at the inlet of the conveyor. Accordingly, a pearlite transformation is effected of any residual austenite.

6 Claims, 5 Drawing Sheets

METHODS FOR HEAT TREATMENT OF STEEL RODS

This is a continuation of application Ser. No. 773,158, filed Sept. 6, 1985, now abandoned.

BACKGROUND OF THE INVENTION

The present invention relates to a method and apparatus for the direct heat treatment of medium- to high-carbon steel rods as they are leaving a hot-rolling mill.

Medium- to high-carbon steel rods made of hot-rolled billets are usually subjected to patenting before wire drawing so as to provide a fine pearlite microstructure having improved cold workability and increased tensile strength.

Lead patenting, the oldest known method of patenting, is a heat treatment wherein a rod heated to 850° C. or higher is cooled by continuous drawing into a bath of molten lead having temperatures in the range of about 450°-650° C. The rod treated by this method has improved workability and mechanical performance. Air patenting wherein the rod is re-heated and subjected to controlled cooling by, for example, blowing cold air against it, is also used extensively as a convenient method.

However, these methods involve the re-heating of a rod that has been cooled to ordinary temperatures. High costs resulting from the additional equipment and manpower required for this purpose are inevitable.

A method of direct patenting has recently been developed. In this method, a hot rod coming from the rolling mill is directly subjected to controlled cooling so as to provide a product having properties comparable to those of the patented rod. This method of direct patenting is also used extensively since it eliminates the reheating step and provides for operation at a lower cost.

While several techniques are used to implement direct controlled cooling in this method, the method of cooling the rolled rod within warm water having a constant temperature is preferred because it can be implemented with simple equipment and at low cost. Unlike cooling with cold water, this method employs "film boiling" wherein a uniform layer of water vapor forms on the surface of the hot rod, thus preventing direct contact between the rod and warm water. As a result, the cooling rate is slowed, and if the proper water temperature is selected, a cooling rate suitable for direct patenting is obtained, yielding a product having a fine pearlite structure.

The rod to be treated by direct patenting is made of a billet that has been produced by continuous casting while it is subjected to electromagnetic stirring so as to avoid the occurrence of microsegregation. However, it sometimes occurs that billets having microsegregation are formed as the starting material for rod production.

The part of a billet affected by microsegregation has such a great hardenability that if it is subjected to ordinary controlled cooling, a product with a martensite structure having no workability may form. Even a billet having no such microsegregation may produce a martensite structure if the cooling equipment and operation are such that the cooling rate varies greatly to cause locate excessive cooling.

The present invention further relates to an apparatus for direct heat treatment for producing steel rods having increased tensile strength and drawability by subjecting hot-rolled steel rods at a high temperature to controlled cooling with a coolant. This apparatus may be used in the production of medium- to high-carbon steel rods for use as springs and tensioning members, either twisted or untwisted, in prestressed concrete (PC).

The following methods and apparatuses for use in the above defined direct heat treatment of rods are widely known.

One of the best known methods is the Stelmor method wherein a spiral coil continuously expanded on a horizontal conveyor is cooled with an air blast. (See Japanese Patent Publication No. 154623/1967). This method provides a rod having a reasonably uniform quality without locally quenched portions. However, the cooling action of this method is rather weak and the resulting rod does not have a sufficient strength. A strong air blast may be used to achieve some increase in the rod strength, but even this strong air blast is unable to effectively cool the overlapping portions of adjacent turns of the coil, and this causes nonuniformity of the rod's strength.

Methods are also known wherein the rod is shaped into a spriral coil which is either wound in warm water (see Japanese Patent Publication No. 8536/1970) or continuously expanded into a sequence of partly overlapping rings on a horizontal conveyor moving through warm water (see Japanese Patent Publication No. 8089/1971). These methods provide rods having uniform quality if boiling water is used as the cooling medium. However, the product has an insufficient tensile strength of about 10 kg/mm$^2$ lower than the value obtained by patenting through a lead bath.

A method has been proposed for providing the coolant with strong turbulence by blowing air into warm water (see Unexamined Published Japanese Patent Application No. 9826/1982), but even a rod treated by this method has a tensile strength which is 5-7 kg/mm$^2$ lower than the value obtained by lead patenting.

It is known that stronger rods can be obtained by using subcooled boiling water (≦95° C.) as a coolant, and apparatuses that materialize this idea have been proposed. If stable film boiling were maintained, the desired heat treatment could be achieved, but in fact nuclear boiling is usually induced even at elevated temperatures higher than the pearlite transformation point, and the resulting local quenching causes a fatal problem, specifically, production of a martensite structure.

A method of direct heat treatment capable of providing the necessary and sufficient cooling rate involving only film boiling and without inducing nuclear boiling even in the case of using subcooled boiling water has been proposed in Japanese Patent Application No. 105558/1984. This method produces medium- to high-carbon steel rods that have a tensile strength comparable to that attained by lead patenting and which are highly uniform in quality and have improved drawability.

In accordance with the method proposed in that application hot-rolled medium- to high-carbon steel rod is treated by performing controlled cooling on spiral coils of the rod, which rod has an austenitic metallurgical structure and which is transported in the form of non-concentrically expanded rings in a generally horizontal direction. Specifically, the spiral coil is passed through a heat treating vessel containing a coolant of a gas bubble-water mixed fluid under strong turbulent action which contains a uniform dispersion of oxidizing gas bubbles and which is held at a temperature not higher than 95° C. The coolant is caused to flow in a predetermined direction and at a predetermined rate so as to provide uniform cooling conditions for the coil along its entire length.

An apparatus has also been proposed for implementing such a method of direct heat treatment and is shown schematically in FIG. 1.

A hot-rolled steel rod 51 as gripped by pinch rollers 52 is pressed through a laying head 53 and deformed into a spiral coil. The coil is dropped on a horizontally positioned conveyor 55 in the form of a sequence of non-concentric rings 54. As they are carried on the conveyor 55, the rings, upon being are subjected to preliminary cooling, successively leave the terminal end of the conveyor 55 to be transferred to a horizontal conveyor 57 positioned within a heat treating vessel 56. The rings are then carried on an inclined conveyor 67 and accumulated in a collector 68 outside of the heat treating vessel.

As the rod 54 moves through the heat treating vessel 56, it is subjected to controlled cooling. For the purpose of controlled cooling, the heat treating vessel 56 is provided with a discharge pipe 62' at the delivery end. The pipe 62' is connected to a heat exchanger 65 and has a bypass that combines with an outlet pipe from the heat exchanger 65 so as to be connected to a warm water tank 64. For the purpose of controlled cooling, the warm water in the tank 64 is held at a constant temperature and is drawn by a circulation pump 66 to be fed into the heat treating vessel 56 through a supply pipe 62 connected to the vessel 56 at a point upstream of the point where the spiral coil 54 is dropped into the vessel 56.

An oxidizing gas supply pipe 60 is provided under the heat treating vessel 56, and an oxidizing gas is blown into the vessel through a plurality of vertical nozzles provided under the horizontal conveyor 57 in the longitudinal direction. The oxidizing gas blown in this way is reduced to tiny bubbles (diameter less than 1 mm) by means of bubble breakers 59 positioned close to the nozzles. Turbulence of the bubbles is effected by an agitator 69. The bubbles pass upward through the horizontal conveyor 57. Generally, the coolant flows in same direction as that of the direction of travel of the conveyor 57. The warm water held at a constant temperature is mixed with the oxidizing gas bubbles to form a gas-water mixed fluid which serves as a coolant for patenting the rod 54.

With the apparatus shown above, the necessary heat treatment is achieved by completing the transformation of an austenite structure to a pearlite structure while the rings of the rod 54 are carried on the horizontal conveyor 567 within the heat treating vessel 56 or while the rings are being transferred from such conveyor 57 to the inclined conveyor 67. Once the rings have been transferred to the horizontal conveyor 57, they will remain in contact with substantially the same positions with respect to the chains making up the conveyors 57 and 67 until the rings are discharged from the vessel 56 on the inclined conveyor 67. This means that the rod 54 undergoes heat treatment as it assumes the form of partly overlapping non-concentric rings without changing the positions of contact with the conveyor chains. As a result, the rod is cooled at varying rates and a product having uniform quality over its entire length cannot be obtained.

FIG. 2 is a CCT curve (continuous cooled transformation diagram) for a high-carbon steel and a part affected by segregation. In the FIG. 2, $P_s$ is a curve through points where austenite to pearlite transformation is started, and $P_f$ denotes a curve through points where such a transformation is finished.

In ordinary controlled cooling, the rod is cooled along the path PQR. Pearlitic transformation is started as the rod passes $P_2$, but if it reaches the dashed line CD without crossing $P_f$, the progress of the pearlitic transformation is arrested and the rod is supercooled to a point $M_s$ where the martensitic transformation takes over, resulting in the formation of a martensite plus pearlite structure. If the rod is quenched without crossing $P_s$, a martensitic transformation occurs, thus producing a martensite structure.

With a homogeneous medium- to high-carbon steel rod, the desired patenting is accomplished by no more than 30 seconds of heat treatment, but if the rod includes microsegregation which contains C and Mn in amounts 1.2 to 2.0 times as much as in areas having no microsegregation, the rod has greater hardenability and takes a few minutes to complete the austentite to pearlite transformation.

Furthermore, as already mentioned, even a homogeneous rod may produce a martensite structure if great variations in cooling rate cause excessive local cooling, as is often encountered in controlled cooling with an air blast, cooling with an air-water mixture, or cooling with warm water, all of which methods involve the laying down of the rod in the form of a sequence of nonconcentric rings.

SUMMARY OF THE INVENTION

In accordance with the present invention, any residual austenite structure resulting from such abnormal cooling or microsegregation is completely transformed to a pearlite structure, and if a local martensite structure has formed in the rod, the latter is sufficiently tempered to reduce any deleterious effects of the martensite structure.

If a medium- to high-carbon steel rod is subjected to direct patenting by, for example, submersion in warm water, the rod is within the temperature range of 450°–630° C. when it passes the curve through the points where the austenite to pearlite transformation is finished, and in this temperature range, any segregation existing in the rod has yet to be transformed to the pearlite structure. If, on the other hand, the rod which has crossed $P_f$ in FIG. 2 and is within the temperature range of 450°–630° C. passes through the region of transformation for the residual austenite structure in the segregated area with high C or MN content (this region is defined by the dashed curves $P_s'$ and $P_f'$) so as to follow the path indicated by the temperature vs. time curve PQS, the residual austenite structure will undergo complete transformation to the pearlite structure while any local martensite structure is sufficiently tempered to reduce its deleterious effect.

The temperature of 450° C. is critical in that below that point the austenite structure will not be completely transformed to the pearlite structure and a residual austenite structure forms. The temperature of 630° C. is also critical in that at higher temperatures the rod becomes excessively soft.

It takes about 60–300 seconds for the residual austenite structure to be transformed to the pearlite structure. The present invention provides a continuous method of direct heat treatment wherein a medium- to high-carbon steel rod, which has been subjected to ordinary controlled cooling, is held isothermally for a period of 60–300 seconds at a temperature in the range of 450°–630° C., thereby causing complete pearlitic transformation of any residual austenite structure that has formed as a result of excessive cooling while providing sufficient tempering effects for that part of the rod which has produced the martensite structure. The lower limit of 60 seconds for the period necessary for the residual austenite structure to transform to the pearlite structure is determined such that the austenite structure still remains untransformed if the rod is held between 450° C. and 630° C. for less 60 seconds. The upper limit of 300 seconds is chosen so that any further isothermal treatment is unnecessary. Longer times will simply result in uneconomic working.

The present invention also provides an apparatus for implementing the above-described method of direct heat treatment. Basically, the apparatus comprises a delivery conveyor that is positioned immediately downstream of the conventional controlled cooling system section and which receives a continuously delivered sequence of non-concentric rings of the rod in such a manner that the ring pitch is about 10 times as dense as in the section of controlled cooling, and a heat holding vessel that covers the delivery conveyor and through which the non-concentric rings of the rod are slowly cooled as they are held in that vessel at 450°–630° C. for a period of 60–300 seconds.

In accordance with further aspects of the present invention, an apparatus is provided wherein a steel rod that is dropped from a loop layer onto a conveyor in the form of a spiral coil is subjected to heat treatment under conditions which are as uniform as possible throughout the period for which the rod is passed through a heat treating vessel and delivered therefrom. In accordance with the invention, the rod is transported on multiple cascade-connected chain conveyors so that the overlapping of adjacent rings of the coil at edge portions is sufficiently reduced to enhance the flow of a coolant at those portions. In addition, each of the chain conveyors is staggered in chain gap width with respect to adjacent cascade-connected chain conveyors so that the position of contact between the chains and the rod will be changed at sufficiently short intervals to avoid the formation of cold sports in any part of the rod.

The apparatus of the embodiment described immediately above is capable of heat treating medium- to high-carbon steel rods either with hot water having a temperature of 95° C. or higher or warm water not hotter than 95° C. However, such apparatus often requires a large space for installation in factories, and in some cases it may be uneconomic to install facility lines for different heat treatments.

Therefore, in accordance with a still further aspect of the present invention there is provided a multi-functional functional apparatus capable of performing a variety of heat treatments using only a single facility line. In accordance with this aspect of the present invention, an upper conveyor line for slowly cooling a hot-rolled steel rod so as to obtain a homogeneous product is added to the above-described heat treatment apparatus. The lower quench line using a gas-water mixed fluid coolant made of either hot or warm water and an oxidizing gas is rapidly switched to the slow cooling line, or vice versa. By properly performing this switching between lower and upper lines, a multi-performance apparatus is provided that exhibits a range of cooling rates from 0.5 to 60° C./sec, which is suitable for a wide range of rapid heat treatments for a variety of steel rods.

In order to provide for the capability of performing the desired heat treatment of a certain steel rod, the lower and upper heat treatment lines must be properly switched from one of the other. This is done in the present invention by using the following arrangement: At the end where the hot-rolled steel rod is supplied, a horizontal roller conveyor is so positioned beneath a loop layer that it can move back and forth in the direction in which the line moves, and a downwardly inclined conveyor communicating with the horizontal roller conveyer is positioned so that it is capable of pivoting about the lower end of inclination to a lower retracted position. At the other end where the rod is delivered, a terminal conveyor is so positioned that it can be retracted upwardly, while a delivery conveyor is provided which can communicate with either the upper terminal conveyor or the lower upwardly inclined conveyor. In order to provide for a variety of heat treatments, a heat insulating tunnel with a detachable cover is provided on the upper slow cooling line and/or the terminal and delivery conveyors. In combination with the lower quench line, the upper slow cooling line provides a broad range of cooling conditions to enable the heat treatment of many types of steel rod.

DESCRIPTION OF THE PREFERRED EMBODIMENTS

Figure 3:
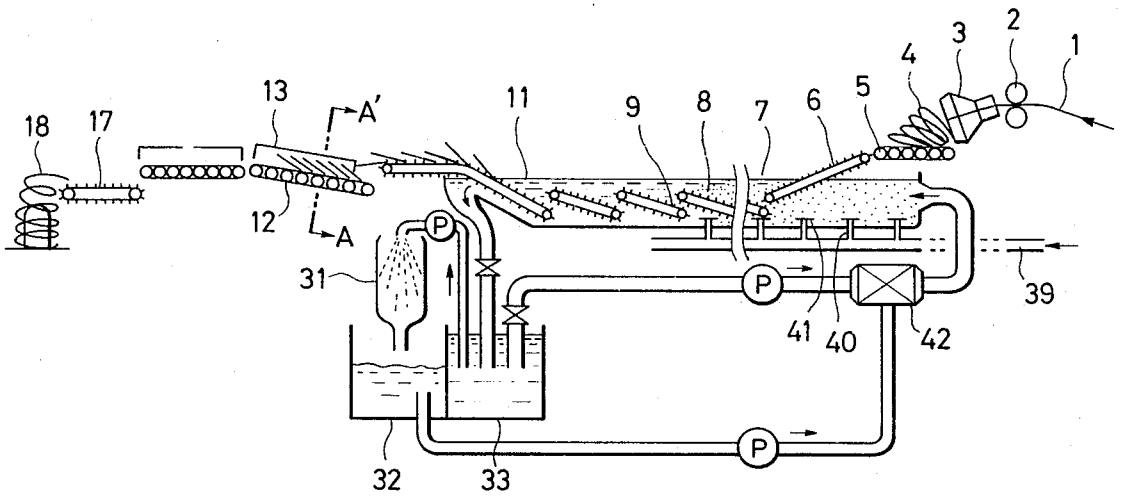
FIG. 3 shows an embodiment of an apparatus used to implement the present invention.

FIG. 3 shows a preferred embodiment of the apparatus for implementing the method of the present invention.

In FIG. 3, 1 is a medium- or high-carbon steel rod that has emerged from the hot rolling mill and 2 is a pair of pinch rollers that grip the rod 1, which is passed through a loop layer 3 to be dropped in the form of a spiral coil.

Reference numeral 5 indicates a horizontal conveyor, and 6 a downwardly inclined chain conveyor that communicates with the horizontal conveyor 5 and which is submerged in a heat treating vessel 7. An upwardly inclined chain conveyor 9 is provided within the vessel 7, communicating with the downwardly inclined chain conveyor 6. This upwardly inclined chain conveyor 9 is cascade connected to other upwardly inclined chain conveyors 9, the last of which, identified by reference numeral 11, communicates with a delivery roller conveyor 12.

The individual upwardly inclined chain conveyors 9 are staggered in height, travel speed and chain gap width, while the conveyor 11 and delivery conveyor 12 are staggered with respect to height and travel speed. Because of this staggered arrangement, the spiral coil 4, composed of non-concentric rings, is capable of moving smoothly from one conveyor to another, and the coil 4 can be transported on the delivery roller conveyor 12 with the individual rings being arranged with a small pitch between each ring.

Figure 4:
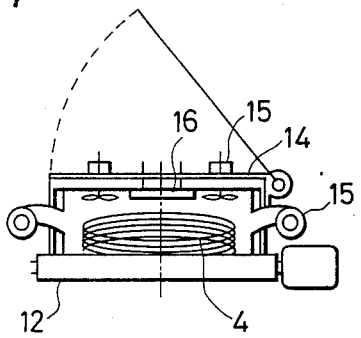
FIG. 4 is a cross section of a heat holding vessel included in the apparatus of FIG. 3.

The delivery roller conveyor 12 is covered with a heat holding vessel, which is generally indicated at 13 in FIG. 3 and shown in cross section in FIG. 4, the latter being taken on a line A—A' in FIG. 3. As shown therein, the vessel 13 is equipped with an insulating cover which has a lid 14 that can be opened at one end. The vessel 13 is also equipped with a convection enhancing fan 15 and a heating element 16. The delivery conveyor 12 moves along the bottom of the vessel. The delivery conveyor 12 further communicates with a delivery chain conveyor 17, which in turn communicates with a collector 18.

Referring further to FIG. 3, 32 is a cold water tank, 33 is a warm water tank, and 31 is a cooling tower. The warm water in the tank 33 and cold water in the tank 32 are drawn by pumps P and mixed in a mixer 42. The mixture, adjusted to a predetermined temperature, is introduced into the heat treating vessel 7 at the end where the rod is inserted and leaves the vessel 7 at the other end where the rod is withdrawn. The mixture leaving the vessel 7 is returned to the warm water tank 33, and part of the returned mixture is cooled in the tower 31 and pooled in the cold water tank 32.

Reference numeral 39 denotes a pipe through which an oxidizing gas is supplied to a plurality of nozzles 40 provided on the underside of the vessel 7 in the longitudinal direction, and 41 is a bubble breaker.

The coolant 8 that has been adjusted to a constant temperature between 60° C. and 100° C. within the mixer 42 is discharged from the end of the vessel 7 that is opposite to the end where the rod is first dipped into the coolant. In accordance with the present invention, the coolant 8 is caused to flow in the vessel 7 at a rate substantially equal to the speed at which the rod 5 travels. An oxidizing gas, for instance, air, may be blown into the vessel 7 through nozzles 40 positioned at selected points of the vessel. The introduced oxidizing gas forms a mixture with the warm water in the vessel and contributes to the consistent and uniform cooling of the rod 4. At the same time, blowing of the oxidizing gas through nozzles 40 at selected points is effective in causing turbulence in the warm water.

While the above description concerns the coolant supplying section, the method of the present invention may be implemented by using air as the sole coolant. In this case, the coolant supply section consists of a blower and air nozzles provided at selected points of the heat treating vessel.

An embodiment of the present invention is hereunder described by reference to the case using as a coolant an oxidizing gas bubble-water mixed fluid that is based on warm water held at temperature between 60° C. and 100° C. and has a gas holdup of 0.1–0.35.

A hot (≧850° C.) medium- or high-carbon steel rod 1 leaving the hot rolling mill is passed through the loop layer 3 to be dropped on the horizontal conveyor 5 in the form of a spiral coil. As the horizontal conveyor 5 moves, the coil deforms to a sequence of non-concentric rings 4 with a pitch varying from 30 to 200 mm. Such rings are transferred from the horizontal conveyor to the downwardly inclined chain conveyor 6 and are passed through the flowing coolant, during which time the greater part of the austentic structure in the entire length of the rod is substantially uniformly transformed to a fine pearlite structure.

Figure 5:
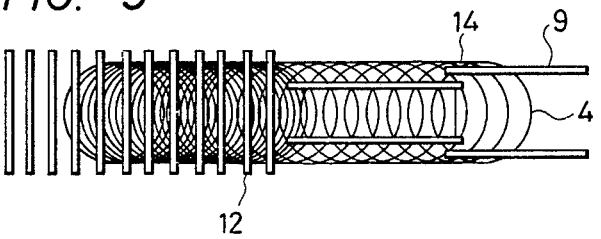
FIG. 5 is a sketch illustrating the difference in pitch between non-concentric rings of a rod carried on an upwardly inclined chain conveyor and those on a delivery roller conveyor.

The transformed rod, which has acquired a temperature between 450° C. and 630° C., is withdrawn from the bath of coolant and transferred to the delivery roller conveyor 12. Because of the staggered relation between the upwardly inclined chain conveyor 11 and the delivery conveyor 12 with respect to height and travel speed, the individual rings of the rod are arranged with smaller pitches between 3 and 30 mm, which is approximately one tenth the pitch while the rod was submerged in the coolant. The appearance of the rod rings as they are transferred from the chain conveyor 11 to the delivery conveyor 12 is shown in FIG. 5.

As already mentioned, the delivery conveyor 12 is covered with the heat holding vessel 13, and in the usual case, the densely arranged non-concentric rings of the rod 4 are within the temperature range of 450° C. and 630° C. By properly selecting the relationship between the length of the vessel 13 and the speed at which the delivery conveyor 12 travels, the moving rod 4 is held within the vessel 13 for a period of 60–300 seconds, during which time any residual austentite will be transformed to pearlite and any existing martensite annealed. Thereafter, the rod, as it is slowly cooled, leaves the vessel 13 and is accumulated by the collector 18.

The convection enhancing fan 15 is used in order to provide a uniform temperature distribution within the heat holding vessel 13, while the heating element 16 is used to compensate for any reduction of temperature in that vessel.

In order to demonstrate the advantages of the present invention, the following experiment was conducted: Billets of SWR H82B were hot rolled to produce eight rod samples (12.0 mmϕ), four of them were homogeneous in structure and the other four had segregation. These samples were cooled under two controlled conditions as shown in Table 1, and two members of each group were subjected to a heat holding treatment in accordance with the present invention, whereas the other two members were given no such treatment. The samples were then checked for their tensile strength and metallurgical structure.

TABLE 1

| Material | Controlled cooling | Heat holding treatment | Tensile strength kg/mm$^2$ | Metallurgical structure |
|---|---|---|---|---|
| Homogeneous steel rod | submerged in warm water 100° C. × 35 sec | negative | 114 | P |
| | | positive (in accordance with the | 114 | P |

TABLE 1-continued

| Material | Controlled cooling | Heat holding treatment | Tensile strength kg/mm$^2$ | Metallurgical structure |
|---|---|---|---|---|
| | | invention) | | |
| | 80° C. × 25 sec | negative | 126, <100 | local M in skin layer |
| | | positive (in accordance with the invention) | 125 | P |
| Segregated steel rod | 100° C. × 35 sec | negative | 113 | M in central segregation |
| | | positive (in accordance with the invention) | 113 | P |
| | 80° C. × 25 sec | negative | 125, <100 | M in segregation and part of the skin layer |
| | | positive (in accordance with the invention) | 125 | P |

P: pearlite
M: martensite

As the above data show, in accordance with the method of the present invention, which combines controlled cooling with a heat holding treatment, the formation of martensite, which would otherwise occur in the skin layer of the rod on account of excessive local cooling, is prevented, and at the same time, the formation of a martensite band in the center of the rod is prevented, even if the starting billet contains segregation.

The method of the present invention can be applied not only to the treatment of medium- or high-carbon steel rods involving controlled cooling with warm water or an air-water mixed fluid coolant, but also to the treatment of such steel rods using controlled cooling with an air blast.

The apparatus used to implement the method of the present invention is not only applicable to segregated rods; it is also applicable to rods that are homogenous in structure but which may produce a local martensite structure depending upon the conditions of subsequent treatment. Furthermore, the apparatus finds uses including not only the treatment of medium- to high-carbon steel rods involving various techniques of controlled cooling, but also the heat treatment of stainless steel rods and other ordinary steel rods.

The formation of center segregation in continuously cast billets cannot be easily avoided. However, in accordance with the present invention, even parts of the rod that include an extremely highly hardenable microsegregation will undergo transformation to a fine perarlite structure, rather than to a martensite structure, by isothermal holding in the temperature range of 500°-600° C. for a period of 60 to 300 seconds. With the prior art technique, a rod hot-rolled from a homogeneous billet will occasionally yield a local martensite structure if the cooling conditions are not uniform. However, by using the method of the present invention, even such undesired martensite is restored to the normal (pearlite) structure, thus providing a homogeneous product.

Figure 1:
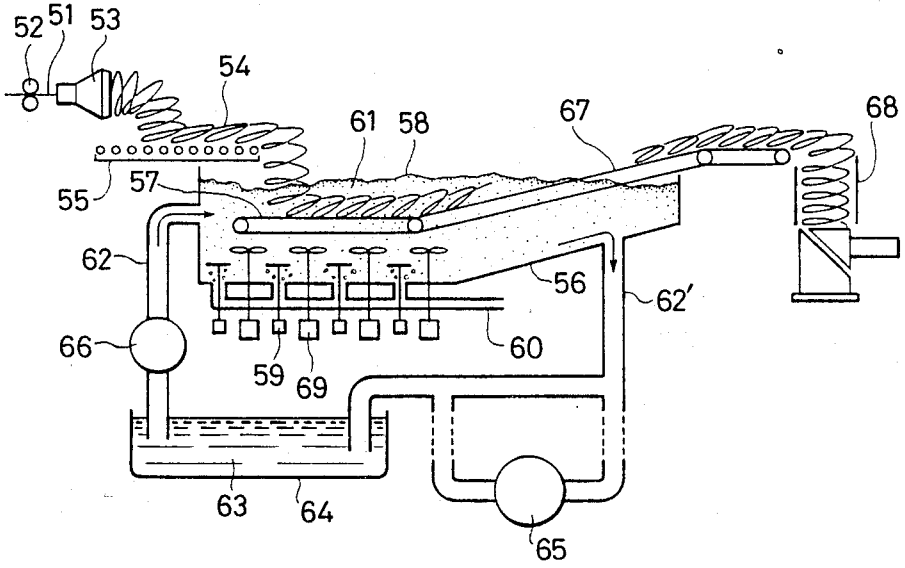
FIG. 1 is a diagram of a conventional apparatus for heat treatment of steel rods.
Figure 2:
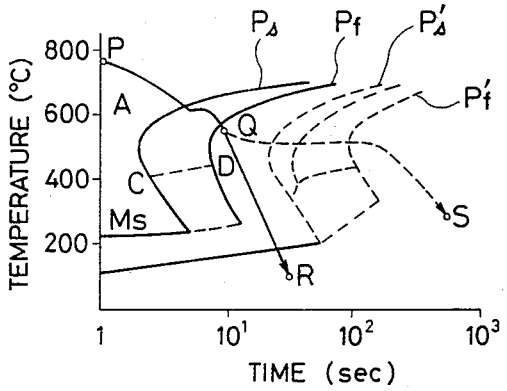
FIG. 2 is a continuous cooled transformation diagram for a medium- or high-carbon steel rod and is intended for illustrating principles of the present invention.
Figures 6, 7:
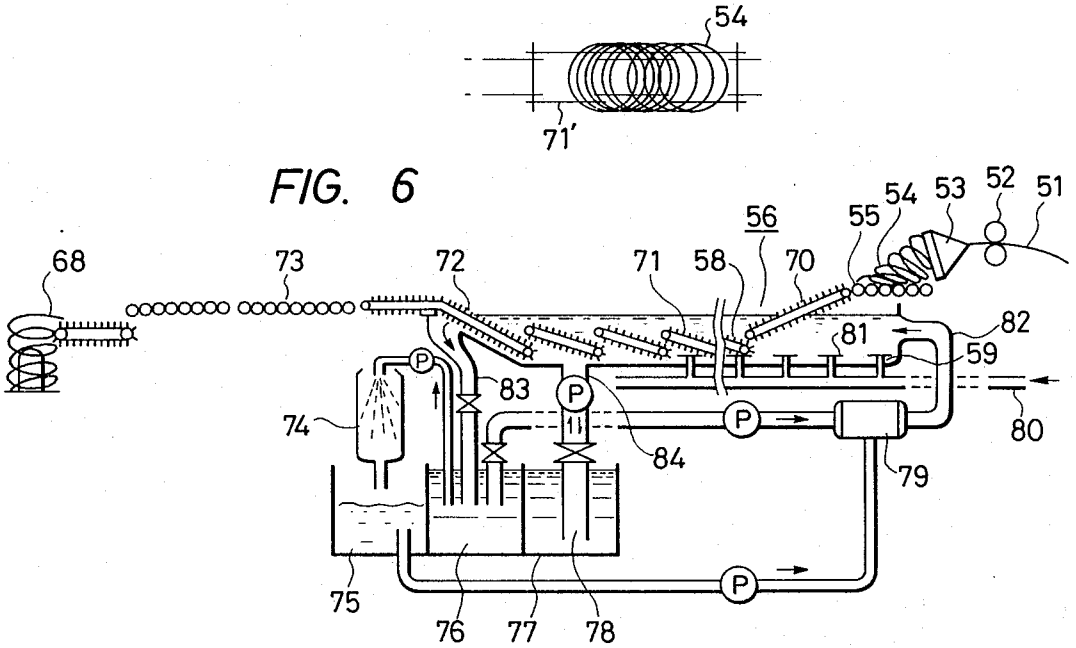
FIG. 6 is a schematic sketch of an apparatus for direct heat treatment constructed in accordance with another embodiment of the present invention.
FIG. 7 illustrates parts of multiple cascade connected chain conveyors used in the apparatus of FIG. 6.

Another embodiment of the present invention is shown in FIG. 6, wherein components which are the same as shown in FIG. 1 are indicated by the same reference numerals.

In FIG. 6, reference numeral 56 represents an elongated heat treating vessel which is provided with pinch rollers 52 and a loop layer 53 at the top of one end. A horizontal conveyor 55 is positioned under the loop layer 53, and the forward end of the conveyor 55 communicates with one end of a downwardly inclined chain conveyor 70. This chain conveyor 70 is inclined at an angle not greater than 30°. The other end of the chain conveyor 70 is disposed within a heat treating vessel 56, and an upwardly inclined chain conveyor 71 is positioned directly under the other end of the chain conveyor 70. A plurality of upwardly inclined chain conveyors 71 are cascade connected in the longitudinal direction of the heat treating vessel in such a manner that the individual conveyors 71 are staggered with respect to height. The end of an upwardly inclined chain conveyor 72 in the last cascaded stage extends beyond the heat treating vessel 56, which is connected to a delivery conveyor 73, which in turn communicates with a collector 68.

The chain conveyor 70, inclined at an angle not greater than 30°, is employed to submerge the rings of rod 54 dropped from the loop layer 53 in the coolant 58 without undergoing any deformation. If, as shown in FIG. 1, the rod is dropped in a spiral coil form onto the conveyor in the coolant, an irregularly arranged sequence of non-concentric rings will often occur. This problem can be avoided by using the downwardly inclined chain conveyor 70.

As shown in FIG. 7, adjacent cascade-connected chain conveyors 71 differ in chain gap width and are so designed that they can be independently adjusted to move at different speeds. Therefore, one chain conveyor 71 can be operated to run at a speed different from that of an adjacent conveyor 71.

A coolant supply pipe 82 is connected to one end of the heat treating vessel 56 where the rod is dipped, while a coolant discharge pipe 83 is connected to the other end where the rod is delivered from that vessel. A pipe 84 is connected to the bottom of the heating treating vessel 56 at a point close to the delivery end in the longitudinal direction of the vessel.

Reference numeral 74 denotes a cooling tower, 75a a coldwater tank, 76; a warm water tank, and 77 is a hot water tank.

The cold water tank 75 and warm water tank 76 are connected to a warm and cold water mixer 79 through respective pumps P. The mixer 79 is connected to the coolant supply pipe 82. The hot water tank 77 is connected to the pipe 84 by a valve and a pump P which is capable of rotating in both forward and reverse directions.

Reference numeral 80 denotes an oxidizing gas supply pipe which is connected to a plurality of nozzles 59 provided on the bottom of the heat treating vessel 56 in the longitudinal direction. Reference numeral 81 denotes a bubble breaker. Agitators using propellers (not shown) are mounted on the bottom of the vessel 56.

Warm water adjusted to a suitable temperature between 65° C. and 95° C. in the mixture 79 is fed into the heat treating vessel 56 through the pipe 82 and is usually returned to the warm water tank 76 through the pipe 83. During the circulation of the warm water, an oxidizing gas supplied through the pipe 80 is blown into the warm water through respective nozzles 59 and is dispersed by the breaker 81 into tiny bubbles with a diameter of about 1 mm. Such bubbles are mixed with the warm water to form a gas-water mixed fluid coolant 58 that flows through the heat treating vessel 56.

The hot-rolled medium- high-carbon steel rod 51, guided by the pinch rollers 52, is sent to the loop layer 53, from which it emerges as a spiral coil that is arranged on the horizontal conveyor 55 in the form of a sequence of non-concentric rings. Depending on the amount of time the rod 54 is present on the horizontal conveyor 55 and on the angle of the adjacent downwardly inclined chain conveyor 70, a suitable degree of preliminary oxidiation is provided for the rod 54.

The substantially non-concentric rings of rod 54 are successively submerged in the fluid coolant for the purpose of effecting a rapid cooling treatment. The coolant 58 flows in the direction parallel to the direction in which the rod 54 moves.

The upwardly inclined chain conveyor 71 is provided in a multiplicity of stages in the coolant 58 so that no part of the rod 54 will undergo austenite to pearlite transformation until it has travelled on all of the chain conveyors 71 (that is, no part of the rod should undergo the transformation when it is on one single chain conveyor 71). At the end of one chain conveyor 71, the overlapping rings of rod 54 are expanded and transferred to the next adjacent chain conveyor 71. Adjacent conveyors 71 are staggered in height and move at different speeds. Furthermore, the gap between two chains 21' of one conveyor 21 differs from that of the adjacent conveyor 71. These arrangements are effective in providing uniform cooling conditions. As shown in FIG. 7, the rings of rod 54 overlap each other more densely on the two side portions than in the center and, hence are subject to weaker cooling action. However, as the rings are transferred from one chain conveyor 71 to the adjacent conveyor 71, they are expanded (they become less densely overlapping) and are contacted by a fresh portion of the coolant 58. As a result, the position of contact between each ring of the rod 54 as well as that between the rod and chains 71' will vary to a sufficient degree to provide uniform cooling conditions.

As already described, the coolant 58 is supplied from the mixer 79 where warm water from the tank 76 and cold water from tank 75 are mixed to obtain a predetermined temperature. The thus-prepared mixture is fed into the heat threating vessel 56 at the dipping end so that it flows at a speed which is substantially equal to the conveyor speed (or the speed at which the non-concentric rings of the rod move). At the same time, an oxidizing gas is blown in the vesssel 56 to cover every part of its inside. The oxidizing gas is dispersed into tiny bubbles which are mixed with the warm water to form a coolant used for performing controlled cooling of the rod 54.

Part of the warm water in the tank 76 flows into the coolant tower 74 where it is cooled and flows into the tank 75. If it is desired to obtain a rod having a tensile strength comparable or close to the value achieved by lead patenting, it is necessary to obtain a sufficiently cool coolant by employing circulation of a mixture of cold and warm water. However, if it suffices to obtain a strength about 10 kg/mm$^2$ lower than the value achieved by lead patenting, it is not necessary to circulate the coolant; instead, the hot water tank 78 is held at 95° C. or higher and the heated water is rapidly passed to the vessel 56 by means of pump P and returned to the tank 78 if it is no longer needed. A surfactant may be incorporated in the hot water.

As will be understood from the foregoing description, the apparatus of this embodiment of the present invention effects controlled cooling of a medium- to high-carbon steel rod with a gas-wter mixed fluid coolant having a temperature between 65° C. and 95° C. so that a product with enhanced tensile strength is obtained.

If heat treatment is conducted when the coolant temperature has dropped to 95° C. or below, non-uniformity will often occur in the quality of the treated rod. In order to avoid this problem, in accordance with the present invention, not only is the moving rod cooled with a gas-water mixed fluid coolant, but the uniform cooling of the rod is ensured by using transport conveyors provided with the special features described above. From the viewpoint of investment costs, it would obviously be uneconomical to use the apparatus of the present invention for the sole purpose of heat treatment. Therefore, in accordance with the invention, a tank for holding warm water hotter than 95° C. may be provided in addition to the cold water tank 74 and warm water tank 76 so that rapid change of coolant can be effected by quickly pumping conventional hot water (≧95° C.) to the vessel 56 as required.

The apparatus of the present invention may be applied not only to the heat treatment of medium- to high-carbon steel rods, but also to the heat treatment of low-alloy steel rods and stainless steel rods.

An example of the results of heat treatment of high-carbon steel rods by the apparatus of the present invention is shown in Table 2.

TABLE 2

| Method | Coolant | Coolant temperature | No. of samples | Average tensile strength kg/mm$^2$ | Standard deviation kg/mm$^2$ |
|---|---|---|---|---|---|
| Conventional | Warm water | 95° C. | 157 | 113.8 | 1.57 |
| In accordance with the invention | Warm water | 98° C. | 80 | 114.1 | 0.82 |
| | Gas-water mixed fluid | 93° C. | 80 | 119.6 | 0.77 |
| | Gas-Water mixed | 83° C. | 80 | 127.5 | 1.00 |

TABLE 2-continued

| Method | Coolant | Coolant temperature | No. of samples | Average tensile strength kg/mm² | Standard deviation kg/mm² |
|---|---|---|---|---|---|
| | fluid | | | | |

Table 2 shows that the tensile strengths of the samples treated by the apparatus of the present invention have smaller standard deviations than the samples treated by the apparatus of the conventional apparatus. Obviously, the samples treated by the apparatus of the present invention had a more uniform quality than the conventional samples.

The apparatus of the present invention provides an inclined chain conveyor on both ends of a heat treating vessel, one end being located where the rod is submerged and the other end where the rod is discharged. Between these two chain conveyors, a plurality of upwardly inclined chain conveyors are cascade connected in such a manner that they are staggered in height and are operated to run at different speeds. With the prior art apparatus, rings of the rod overlap each other more densely at the two side portions in the direction of their advancement than in the center so that different parts of the rod are cooled at different rates. However, this difference in the rate of cooling the rod can be reduced to a very small value with the use of the present invention. In addition, no cold spots will occur at the points of contact between the rings of the rod and the conveyor chains because the chain gap width is varied from one conveyor to another. The rod treated by the present invention is so highly uniform in quality in that the amount of variation of tensile strength at different positions in each of the rings is extremely small.

The rate of cooling of the rod can be easily changed by varying the temperature of the gas-water mixed fluid coolant. For example, a variation in tensile strength of about 15 kg/mm² can be obtained within the coolant temperature range of 65°-95° C.

A further advantage results from the fact that if a hot water tank is added to the apparatus of the present invention, it becomes possible to heat treat rods by using as the sole coolant either the conventional warm water (≧95° C.) or such warm water containing a surfactant. The apparatus of the present invention equipped with such a hot water tank may be used as a multi-function system for direct heat treatment and will present a great economic benefit in terms of lower investment cost.

Figure 8:
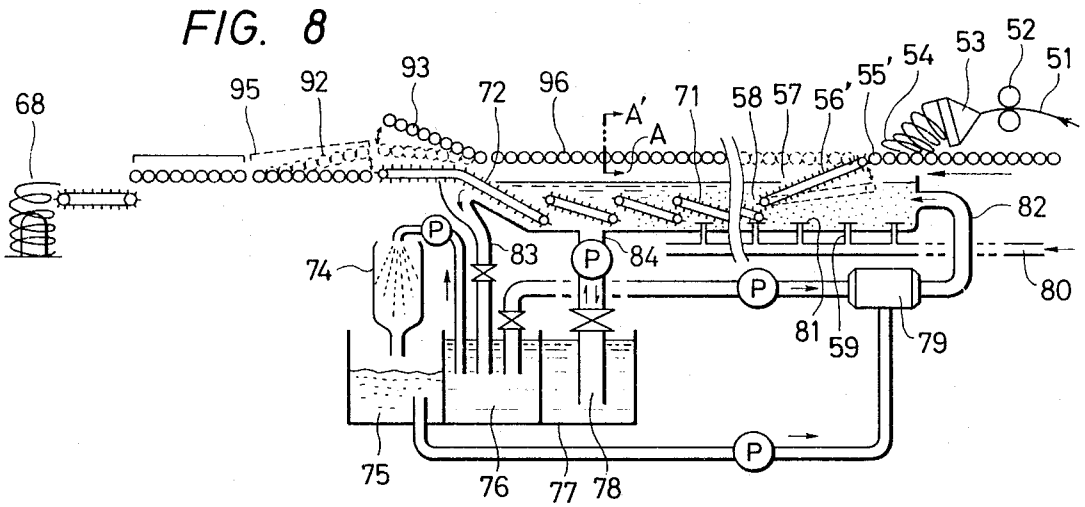
FIG. 8 shows an apparatus of another embodiment of the present invention.

A still further embodiment of the present invention is shown in FIG. 8.

In FIG. 8, in which like reference numerals used in FIG. 6 denote like elements, the quench line that is responsible for the heat treatment of steel rods with a gas-water mixed fluid medium and hot water is substantially the same as what is shown in FIG. 6. The slow cooling line is positioned above the heat treating vessel 57 in this quench line. The first component of the slow cooling line is a slow cooling conveyor 96 that is disposed in the longitudinal direction of the heat treating vessel 57 and in close contact with one end of the horizontal roller conveyor 55'.

The horizontal conveyor 55' is designed so that it will slide back and forth in the direction in which the line advances. As shown, a downwardly inclined chain conveyor 56' is constructed so that it is capable of pivoting about its lower end to a position lower than that where it is connected to the horizontal conveyor 55'. After pivoting, the chain conveyor 56' is advanced in the line direction so that it communicates with one end of the slow cooling conveyor 96. In this mode, a rod 54 that has been dropped from the loop layer 53 in the form of a spiral coil is continuously transported on the horizontal conveyor 55' in the form of non-concentric rings and delivered to the slow cooling conveyor 96.

A terminal conveyor 93 is provided which communicates with the terminal end of the slow cooling conveyor 96. This terminal conveyor 93 is positioned above the upwardly inclined chain conveyor 72 and is so constructed that it is capable of pivoting upwardly (as indicated by dashed lines) about the upstream end of the conveyor 93 or about the point at which the conveyor contacts the slow cooling conveyor 96. When the lower line is used, the conveyor 93 is pivoted to the upper retracted position so that it will not impede smooth passage of the successive turns of rings of the rod 54 that are being carried by the upwardly inclined chain conveyor 72.

Reference numeral 92 represents a delivery conveyor that is adjacent to the terminal conveyor 93 and which is used as a common element of both upper and lower lines. The delivery conveyor 92 has a level adjusting mechanism that enables it to pivot about its downstream end so that its upstream end can contact with either the terminal conveyor 93 or the upwardly inclined chain conveyor 72.

Figure 9:
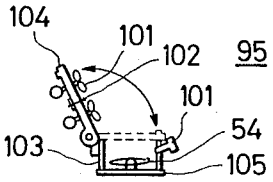
FIG. 9 shows a heat insulating tunnel provided on a slow cooling conveyor in the apparatus of FIG. 8.

Although not shown specifically in FIG. 8, a heat insulating tunnel 95, shown in FIG. 9 in a cross section taken on a line A—A' in FIG. 8, is provided on the slow cooling conveyor 96. The insulating tunnel 95 is composed of side plates 103 and a cover 94 which is detachably supported on the side paltes. This tunnel is positioned to cover the slow cooling conveyor 96 in its longitudinal direction. Convection enhancing fans 101 are provided at several points on each of the cover 104 and side plates 103. The cover 104 is also equipped with a heating element 102. Reference numeral 105 in FIG. 9 denotes a roller. If necessary, each of the terminal conveyors 93 and the delivery conveyor 92 may be equipped with a heat insulating tunnel that has a detchable cover and which has the same construction as described above.

The rate of cooling with this slow cooling line is typically controlled by adjusting the pitch between adjacent non-concentric rings of the rod 54 in a known manner. Alternatively, the same object may be achieved by attaching or detaching the cover 104 or by adjusting the convection enhancing fans 101 and heating element 102. It should be noted that the fans 101 are essential for minimizing the difference in cooling rate between both side portions of each non-concentric ring and its center portion.

The slow cooling line described above is used in annealing low-carbon steels and low-alloy steels.

In accordance with the slow cooling line included in the apparatus of the present invention, cooling rates in the range of 0.3°-10° C./sec can be obtained by adjusting the heating source 102 in addition to the adjustment of the pitch between adjacent nonconcentric rings of the rod. On the other hand, if the lower quench line that uses hot water or a gas-water mixed fluid as a coolant, cooling rates in the range of 5°-60° C./sec can be obtained. Therefore, the apparatus of this embodiment of the present invention can be used as a multi-function apparatus for direct heat treatment.

The heat treatments that can be realized by the apparatus of this embodiment of the invention may be summarized as follows:

(1) patenting;
(2) light homegenous patenting;
(3) direct annealing;
(4) direct quenching (in a gas-water mixture of 50°-80° C.; and
(5) solution heat treatment of stainless steels.

As described in the foregoing, the apparatus of this embodiment of the present invention includes a quench line and slow cooling line that are capable of performing two different kinds of heat treatment or cooling on steel rods. The two cooling lines have in common a loop layer, a horizontal roll, and the sections for steel rod delivery and collection downstream of a delivery conveyor, the slow cooling line being positioned to lie above the quench line. This arrangement is very effective in reducing the installation space required and the investment cost, while at the same time, one cooling line can be readily and rapidly changed to the other in order to effect the intended heat treatment.

A heat insulating tunnel having a detachable cover may be provided over the conveyor in the slow cooling line, and if necessary, a similar heat insulating tunnel having a detachable cover may be provided over the terminal conveyor and delivery conveyor. By providing such insulating tunnels and by properly setting and controlling the heat treatment conditions, the apparatus of the present invention may be used to achieve such heat treatments as (1) patenting, (2) low-strength patenting, (3) direct annealing, (4) direct quenching, and (5) solution heat treatment of stainless steels.

We claim:

1. In a method for direct heat treatment of a medium-to-high-carbon steel rod, which comprises transporting hot-rolled rod on a conveyor in the form of a sequence of non-concentric rings having a pitch within a first range of pitch values and, during a first time period, direct patenting the rod by subjecting said rod to controlled cooling in a coolant medium, to a end of direct patenting temperature within a range of 450°-630° C. so that the greater part of the austenite in the entire length of the rod is substantially uniformly transformed to a fine pearlite structure, the improvement comprising:

after said direct patenting and during a second time period greater than 60 seconds, while continuing to transport said rod on said conveyor, holding said sequence of non-concentric rings of rod isothesmally at approximately said end of direct patenting temperature within the range of 450° C.-630° C. and extending said pitch from said first range to a second range comprising pitch values outside of and smaller than said first range values, whereby contact of overlapping portions of said rod as well as contact of said rod with said conveyor is changed so as to cause pearlitic transformation of substantially any residual austenite.

2. The method according to claim 1, further comprising the steps of: shaping the hot-rolled rod into a sequence of non-concentric rings, said pitch being within a first range comprising a pitch of 30-200 mm, and said second range comprises a pitch of 3-30 mm.

3. The method according to claim 1 or 2, wherein said step of controlled cooling is effected by immersing the rod within a coolant medium comprising one of warm water and a coolant made of a gas-water mixed fluid.

4. The method according to claim 1 or 2, wherein said step of controlled cooling is effected by blowing an air blast against the rod.

5. The method according to claim 2 wherein said second time period does not exceed 300 seconds.

6. The method according to claim 1 wherein the conveyor surface is modified along its length in order to facilitate different points of contact between said coil and said conveyor.

* * * * *